US007735421B2

(12) United States Patent
Vosseler

(10) Patent No.: US 7,735,421 B2
(45) Date of Patent: Jun. 15, 2010

(54) METHOD FOR MANUFACTURING A PRINTING FORM AND PRINTING FORM WITH THERMALLY INSULATING LAYER

(75) Inventor: Bernd Vosseler, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/363,301

(22) Filed: Jan. 30, 2009

(65) Prior Publication Data

US 2009/0127318 A1 May 21, 2009

Related U.S. Application Data

(62) Division of application No. 11/212,396, filed on Aug. 25, 2005, now abandoned.

(30) Foreign Application Priority Data

Aug. 25, 2004 (DE) ..... 10 2004 041 277

(51) Int. Cl.
*B41C 1/10* (2006.01)
*B41N 1/04* (2006.01)
*B41M 1/06* (2006.01)

(52) U.S. Cl. ..... 101/463.1; 101/450.1; 101/453; 228/17; 228/115; 228/117; 228/118; 228/235.2

(58) Field of Classification Search ..... None
See application file for complete search history.

(56) References Cited

U.S. PATENT DOCUMENTS 827,696 A * 7/1906 Lewis ..... 228/158
6,676,896 B1 * 1/2004 Baumeister ..... 419/61
2002/0139269 A1 * 10/2002 Riepenhoff et al. ..... 101/453

FOREIGN PATENT DOCUMENTS

EP 1245385 A2 10/2002

OTHER PUBLICATIONS

R.M. Costescu, et al., Ultra-Low-Thermal Conductivity in W/AL2O3 Nanolaminates, www.sciencemag.org, Science, vol. 303, Feb. 13, 2004, pp. 989-900.

* cited by examiner

*Primary Examiner*—Judy Nguyen
*Assistant Examiner*—Joshua D. Zimmerman
(74) *Attorney, Agent, or Firm*—Laurence A. Greenberg; Werner H. Greenberg; Ralph E. Locher

(57) ABSTRACT

Reusable printing forms and thermal image setting on the printing forms is optimized in terms of performance. A method for manufacturing the printing form, in particular a rewritable printing form, having a thermally insulating layer, is distinguished by the fact that the thermally insulating layer is produced by the configuration of individual layers to form a layer sequence as a multilayer system. A printing form which is manufactured by the method according to the invention can have images set on it with a low power image setting device, as it is possible to effectively prevent heat from dissipating in an undesirably pronounced manner, for example into a metallic carrier.

7 Claims, 4 Drawing Sheets

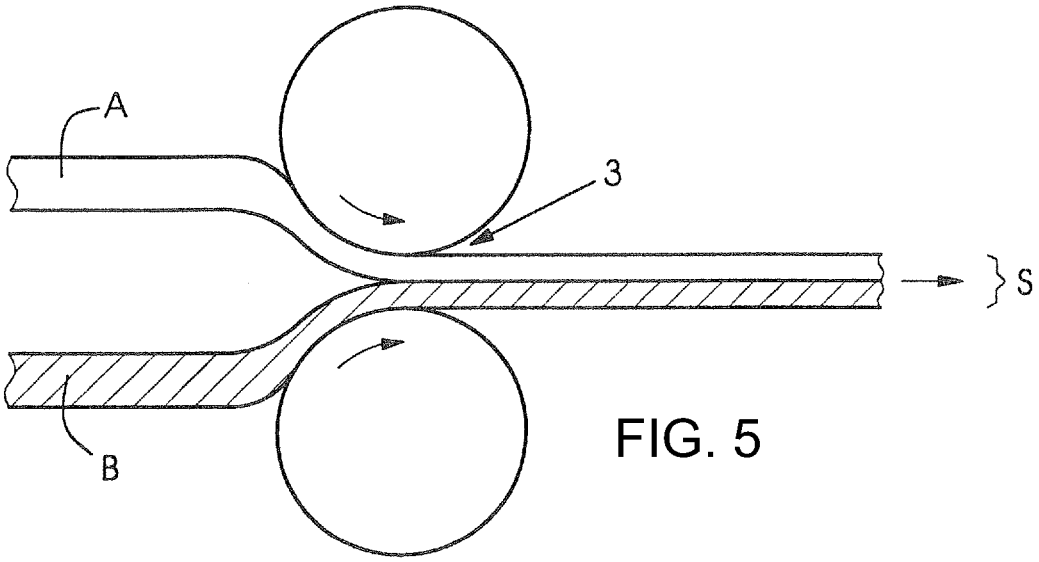
FIG. 5
FIG. 6
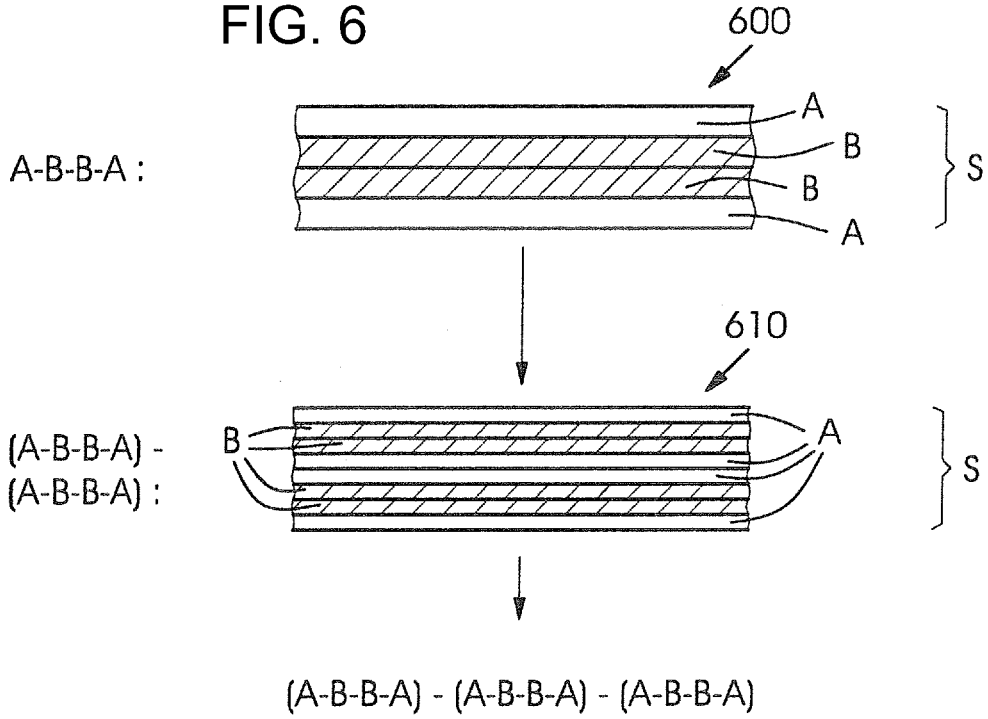

METHOD FOR MANUFACTURING A PRINTING FORM AND PRINTING FORM WITH THERMALLY INSULATING LAYER

CROSS-REFERENCE TO RELATED APPLICATION

This is a divisional application of application Ser. No. 11/212,396, filed Aug. 25, 2005; the application also claims the priority, under 35 U.S.C. §119, of German patent application No. DE 10 2004 041 277.4, filed Aug. 25, 2004; the prior applications are herewith incorporated by reference in their entirety.

BACKGROUND OF THE INVENTION

Field of the Invention

The present invention relates to a method for manufacturing a printing form with a thermally insulating layer. Furthermore, the present invention relates to a printing form having a thermally insulating layer.

Reusable printing forms which can have images set on them digitally are known from the prior art. Reusable, that is to say rewritable, printing forms of this type usually have a carrier or a substrate, for example a metal sheet or a plastic film. A layer which can have images set on it is usually disposed on the carrier. The layer formed on the substrate can have images set on it thermally in accordance with the printing image which is to be produced, for example by the use of an infrared laser.

The use of a metal surface as a substrate for a printing form which can be rewritten or have new images set on it requires high image setting performance, as, on account of the high thermal conductivity of metals, the thermal energy which is introduced into the layer which is to have images set on it by an image setting laser is partially led away by the adjacent metal surface, that is to say dissipates partially into the metal carrier.

European published patent application EP 1 245 385 A2 and U.S. patent application publication US 2002/0139269 A1 describe a printing form having a carrier layer and an upper layer which can be changed photocatalytically and thermally. Under the action of infrared radiation, the printing form can be hydrophobicized thermally point by point, while it is possible to hydrophilicize the whole area of the printing form photocatalytically under the action of ultraviolet radiation. In order for it to be possible to reduce the laser power required for image setting, it is proposed to provide a thermally insulating intermediate layer between the upper layer and the carrier layer, that is to say a layer with a low thermal conductivity. The insulating intermediate layer prevents undesirably high heat emission to the carrier layer. Moreover, in order for it to be possible to reduce the required laser performance further, it is proposed to increase the absorption of the thermal image setting radiation by the introduction of absorption centers into the upper layer or by the arrangement of an absorption layer below the upper layer.

Furthermore, it is known from the pertinent technical literature (cf. Science, Vol. 303, Feb. 13, 2004, pages 989-90) that it is possible for a multilayer system formed with one or more materials to have a considerably lower thermal conductivity than each of the materials by itself. A background of this effect is the fact that the thermal conductivity $\lambda$ is dominated in a multilayer system by the heat transfer coefficient G (measured in $W/m^2K$) at the transitions between the individual layers. If all the individual layers have the same thickness $\delta$, then the following is approximately true: $\lambda=\delta*G$.

SUMMARY OF THE INVENTION

It is accordingly an object of the invention to provide a method for manufacturing a printing form and an associated printing form with a heat insulating layer which overcomes the above-mentioned disadvantages of the heretofore-known devices and methods of this general type and which provides for a further improved method and printing form which can have images set on it with lower power image setting devices.

With the foregoing and other objects in view there is provided, in accordance with the invention, an improved method of manufacturing a printing form having a thermally insulating layer, the method which comprises:

forming the thermally insulating layer by disposing a plurality of individual layers to form a layer sequence of a multiple layer system.

With the above and other objects in view there is also provided, in accordance with the invention, a printing form, comprising:

a substrate;

a thermally insulating layer formed on said substrate, said thermally insulating layer comprising a multilayer system.

A method according to the invention for manufacturing a printing form having a thermally insulating layer is distinguished by the fact that the thermally insulating layer is produced by the arrangement of individual layers to form a layer sequence as a multiple layer system. According to the invention, the thermally insulating layer of the printing form is not produced as an individual layer, as is otherwise customary in printing forms, but is produced as a multiplicity of at least two individual layers which are arranged as a layer sequence and form a multiple layer system. In this way, an advantageous printing form which is optimized with regard to reduced image setting energy can be manufactured. Undesirable heat transport, which has a negative effect on image setting, through the thermally insulating layer or intermediate layer, that is to say through the multiple layer system, is largely reduced or is even negligible. As a result, the advantage is attained that an inexpensive image setting device with a low image setting power can be used to set images on printing forms which are manufactured according to the invention.

According to one preferred embodiment of the method according to the invention which is optimized with regard to an inexpensive manufacturing process which can be used in mass and/or endless production, the layer sequence can be produced by roll bonding, in particular of metal sheets or metal strips. The process of roll bonding is advantageously suitable for providing, in a short time, a large amount of very thin layer systems with a large number of individual layers, for example more than 10 or more than 100 or more than 1000 individual layers. Furthermore, the process of roll bonding can be incorporated into the existing process of printing form manufacture; that is to say, in other words, the printing forms can be provided with roll bonded layer systems in the continuous manufacturing process.

According to a further preferred embodiment of the method according to the invention which is optimized with regard to a uniform and long life product, an A-A layer sequence or a multiple of an A-A layer sequence can be produced from a metal A, in particular titanium, zirconium or aluminum. Curvatures advantageously do not occur, or only occur to an insubstantial extent, during the manufacturing process of the layer system when only one metal is used, on account of the identical properties, such as the elasticity, of the two metal surfaces which are to be joined. Moreover, no problems, or only negligible problems, are to be expected in the event of a later curvature of the layer system, for example when it is pulled onto a cylinder.

According to a further preferred embodiment of the method according to the invention which is optimized with regard to a simplified and largely unproblematic manufacturing process, an A-B-B-A layer sequence or a multiple of an A-B-B-A layer sequence can be produced from a metal A, in particular titanium or zirconium, and a metal B, in particular aluminum. The manufacture of an A-B layer sequence and the joining together of two A-B layer sequences to form a symmetrical A-B-B-A layer sequence, and the further joining together of A-B-B-A layer sequences has the abovementioned advantage that, after the manufacture of the A-B layer sequence, only identical metals (A or B) are always joined together.

According to a further preferred embodiment of the method according to the invention which is optimized with regard to a product with increased thermal insulation, foreign substances can be introduced in a targeted manner between the layers of the layer sequence, in particular in the form of an oxide layer or a nitride layer, in order to reduce the heat transfer between the layers of the layer sequence. The introduction of the foreign substances, which also comprises the introduction of only one type of foreign substance, is a process which can be carried out simply and advantageously improves the insulation effect of the layer system which is based on the low thermal conductivity.

According to a further preferred embodiment of the method according to the invention which is optimized with regard to a product with increased thermal insulation, cavities, in particular air-filled cavities or pores, can be introduced in a targeted manner between layers of the layer sequence, in particular by rolling metal sheets or strips with a rough surface, in order to reduce the heat transfer between the layers of the layer sequence. The introduction of cavities is also a process which can be carried out simply and advantageously improves the insulation effect of the layer system which is based on the low thermal conductivity. In addition, there can be provision for both foreign substances and cavities to be introduced.

A printing form according to the invention having a thermally insulating layer is distinguished by the fact that the thermally insulating layer comprises a multiple layer system.

Advantages are associated with a printing form according to the invention which has a thermally insulating multiple layer system, as have been described in the above text with regard to the manufacturing method according to the invention and the products which are manufactured in such a way. The same is true for the advantages of the preferred embodiments of the printing form according to the invention.

The energy which is required for the structuring process, in particular laser energy, is advantageously minimized for a printing form according to the invention having a printing surface which has images set on it by chemical modification and/or coating and by a structuring process, it being necessary to exceed a critical temperature at the surface during the structuring process. A printing form of this type can be referred to as a performance optimized printing form.

The following requirements result for a performance optimized printing form according to the invention:

As low a heat transfer as possible in a region near the surface. The thickness of the region in which the thermal conductivity has to be low is dependent on the value of said thermal conductivity and the duration of the action of the laser radiation during image setting. The region with a particularly low thermal conductivity should be larger by at least a factor of 2.3 than the thermal penetration depth $\delta w=2*\mathrm{sqrt}(\lambda*t/\rho*c)$, where $\lambda$ is the thermal conductivity, t is the duration of the action, $\rho$ is the specific density and c is the specific heat capacity of the material. Typical values for the minimum thickness of the region with a low heat transfer lie between 5 μm and 50 μm.

As low a reflection coefficient as possible for the light which is used for image setting.

Suitable chemical properties of the surface for a selected switching process between hydrophilicity and hydrophobicity, that is to say preferably for a thermally induced transition from the hydrophilic to the hydrophobic state or vice versa.

Moreover, the surface is to be as robust as possible with respect to the processes of image setting, printing and initialization.

In order to minimize the thermal conductivity of a layer sequence, firstly the thickness $\delta$ of the individual layers can be minimized, and secondly the thermal transfer coefficient G can be minimized.

In order to obtain a stack or a layer sequence comprising individual layers which are as thin as possible, a coating would be possible, for example, in which two materials are deposited alternately in each case in thin layers, for example metallic Al and $Al_2O_3$ ceramic. However, a disadvantage of a method of this type is that, in PVD processes which achieve sufficiently thin layer thicknesses, very good interfaces between partial layers are typically also attained which have a large thermal transfer coefficient G. Moreover, the vapor deposition of layer systems having an overall thickness of a few tens of micrometers in the PVD method takes a lot of time and is therefore expensive.

According to one preferred embodiment of the printing form according to the invention, the multiple layer system can therefore be a roll bonded multiple layer system.

According to a further preferred embodiment of the printing form according to the invention, the multiple layer system can comprise an A-A layer sequence or a multiple of an A-A layer sequence comprising a metal A, in particular titanium, zirconium or aluminum.

According to a further preferred embodiment of the printing form according to the invention, the multiple layer system can comprise an A-B-B-A layer sequence or a multiple of an A-B-B-A layer sequence comprising a metal A, in particular titanium or zirconium, and a metal B, in particular aluminum.

According to a further preferred embodiment of the printing form according to the invention, foreign substances, in particular in the form of an oxide layer or a nitride layer, can be arranged between individual layers of the layer sequence, which foreign substances reduce the heat transfer between the individual layers of the layer sequence.

According to a further preferred embodiment of the printing form according to the invention, cavities, in particular air-filled cavities, can be arranged between individual layers of the layer sequence, which cavities reduce the heat transfer between the individual layers of the layer sequence.

A machine according to the invention which processes printing material, in particular a printing press or a planographic printing press, having a cylinder, is distinguished by the fact that the circumferential surface of the cylinder is provided with a printing form (as described above in relation to the invention), or by the fact that the circumferential surface of the cylinder forms a printing form (as described above in relation to the invention).

Other features which are considered as characteristic for the invention are set forth in the appended claims.

Although the invention is illustrated and described herein as embodied in a method for manufacturing a printing form, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 5 illustrates a further embodiment of the manufacturing method according to the invention;

FIG. 6 is a partial sectional showing an embodiment of a layer system of the printing form according to the invention.

DETAILED DESCRIPTION OF THE INVENTION

Figure 1:
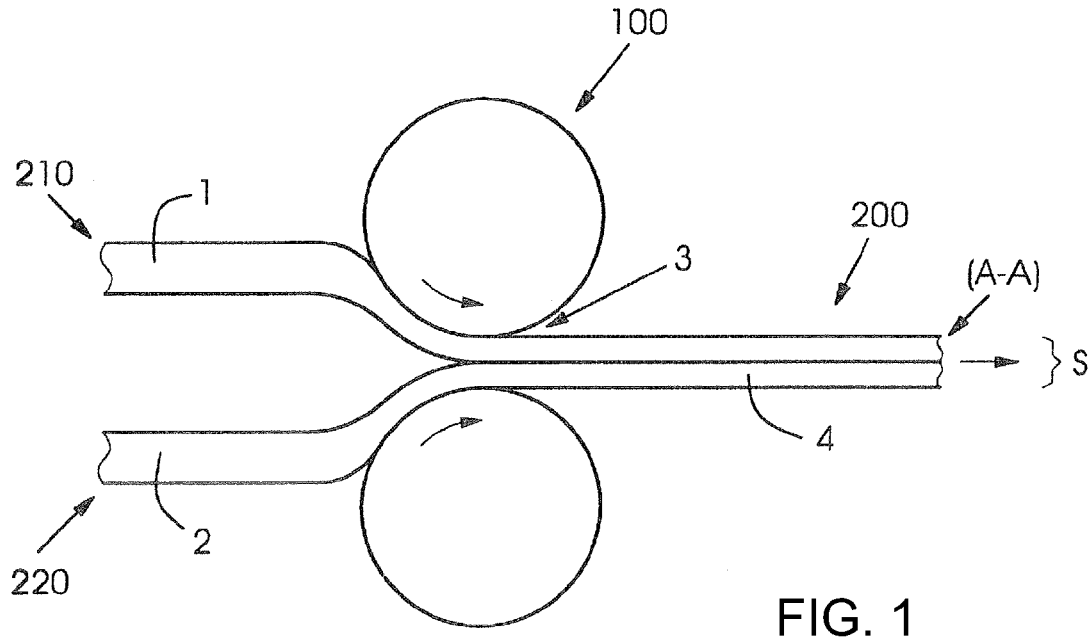
FIG. 1 is a diagrammatic side view illustrating an embodiment of the manufacturing method according to the invention, during a first pass.

Referring now to the drawing figures in detail and first, particularly, to FIG. 1 thereof, there is shown an embodiment of the manufacturing method according to the invention for manufacturing a layer sequence S in a first pass of two metal strips or metal sheets 1, 2 through an apparatus for roll bonding 100. During roll bonding, identical or different metal strips or metal sheets 1, 2, that is to say, in particular, identical (A, A) or different (A, B) metals A and/or B, can be welded over the whole surface area to one another to form a strip 4. During every rolling pass, that is to say during every pass through a roll nip 3 of the apparatus 100, the strip experiences a lengthening which has the reciprocal value of the decrease in thickness, that is to say if a strip is rolled to half its thickness, its length is doubled. The result is an A-A or A-B layer sequence 200 comprising individual layers 210 and 220 A and/or B (in FIG. 1, the A-A layer sequence is shown by way of example).

Figure 2:
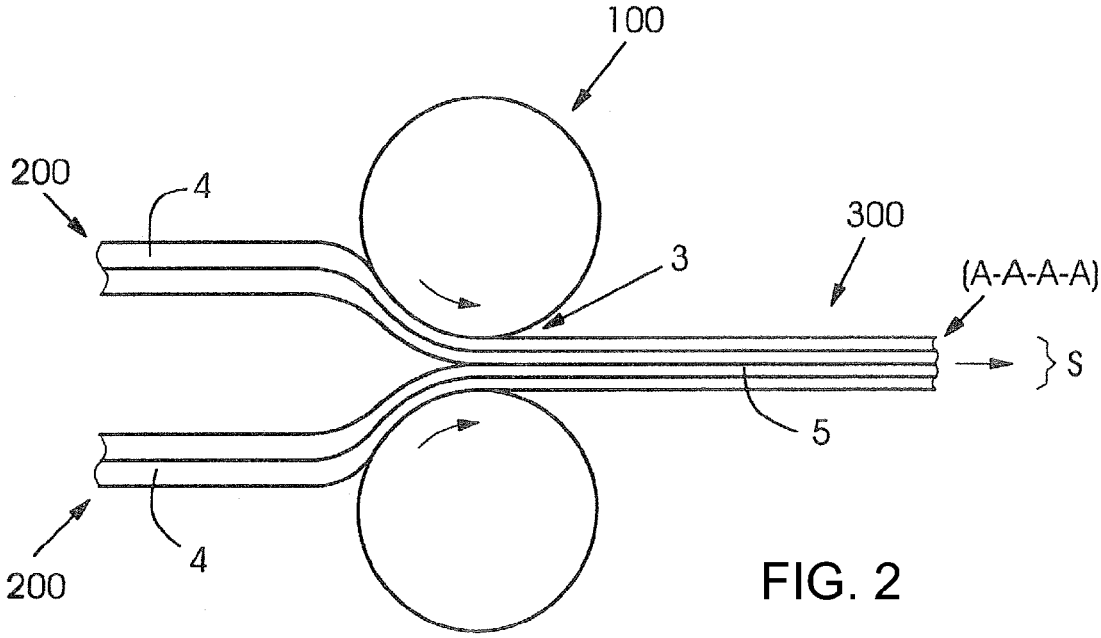
FIG. 2 is a similar view showing the embodiment of the manufacturing method according to the invention, during a second pass.

FIG. 2 shows the embodiment of the manufacturing method according to the invention for manufacturing a layer sequence S in a second pass through the apparatus for roll bonding 100. If a strip 4, which is manufactured, for example, in accordance with the method in FIG. 1 and which comprises two identical or different partial strips which are connected to one another, is divided and the two halves produced are joined together by roll bonding to again form a strip 5 with the thickness of the original strip, the result is a strip which now comprises four partial strips or individual layers instead of two, in each case having half the initial thickness. This produces an A-A-A-A or A-B-B-A layer sequence 300 comprising individual layers 200 A and/or B (in FIG. 2, the A-A-A-A layer sequence is shown by way of example).

If this process is repeated, a very large number of very thin layers of the metals can be obtained by a relatively low number of steps; for example, a system comprising 1024 correspondingly thin individual layers can be obtained by repeating the rolling process ten times by which a strip is rolled to half its thickness (this process can also comprise a plurality of roll passes).

Figure 3:
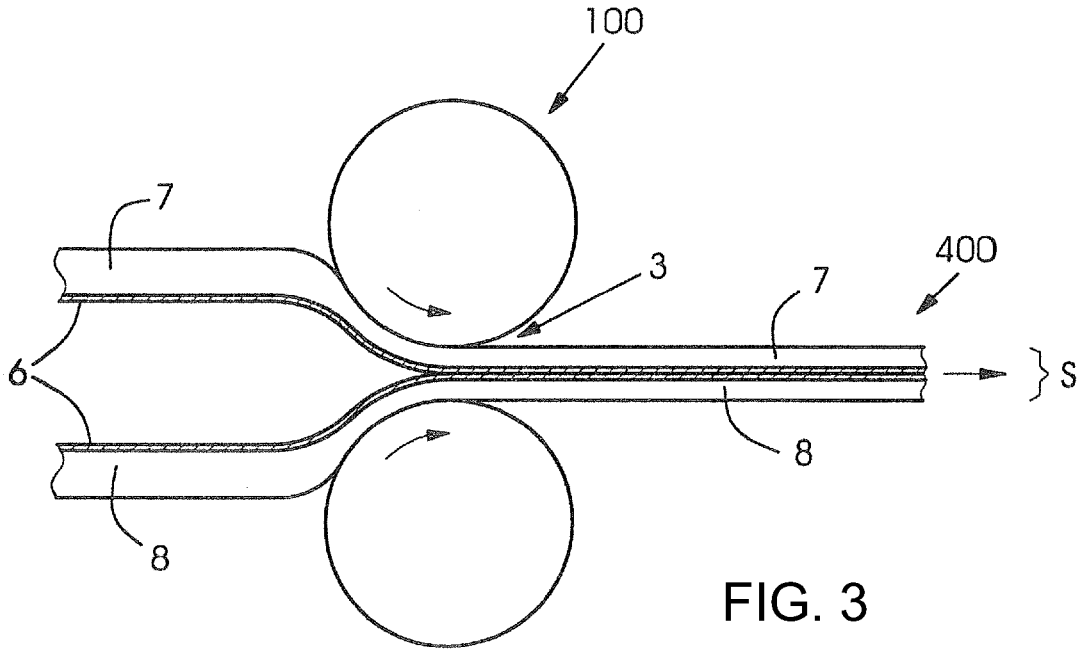
FIG. 3 is a diagrammatic side view illustrating a further embodiment of the manufacturing method according to the invention.

FIG. 3 shows a further embodiment of the manufacturing method according to the invention for manufacturing a layer sequence S. If a layer stack, for example a layer sequence 400, is manufactured by means of repeated roll bonding, the heat transfer coefficient G can be reduced, for example, by rolling in foreign substances 6 on the interface between the two partial stacks or partial sequences 7, 8 which are to be roll bonded. The foreign substances 6 can be introduced in one, a plurality of or all the repetition steps.

Foreign substances 6 of this type can be, for example, an oxide or nitride layer. In the case of titanium and aluminum, an oxide layer is formed naturally, but it can also be made thicker in a targeted manner, for example by anodization. The foreign substances 6 which are rolled in firstly form a barrier for the heat, as it were an additional heat transition in the case of every layer, and secondly they reduce the intermetallic layer bond between two adjacent metal layers, which for its part leads to a reduced heat transfer coefficient G at this interface.

Figure 4:
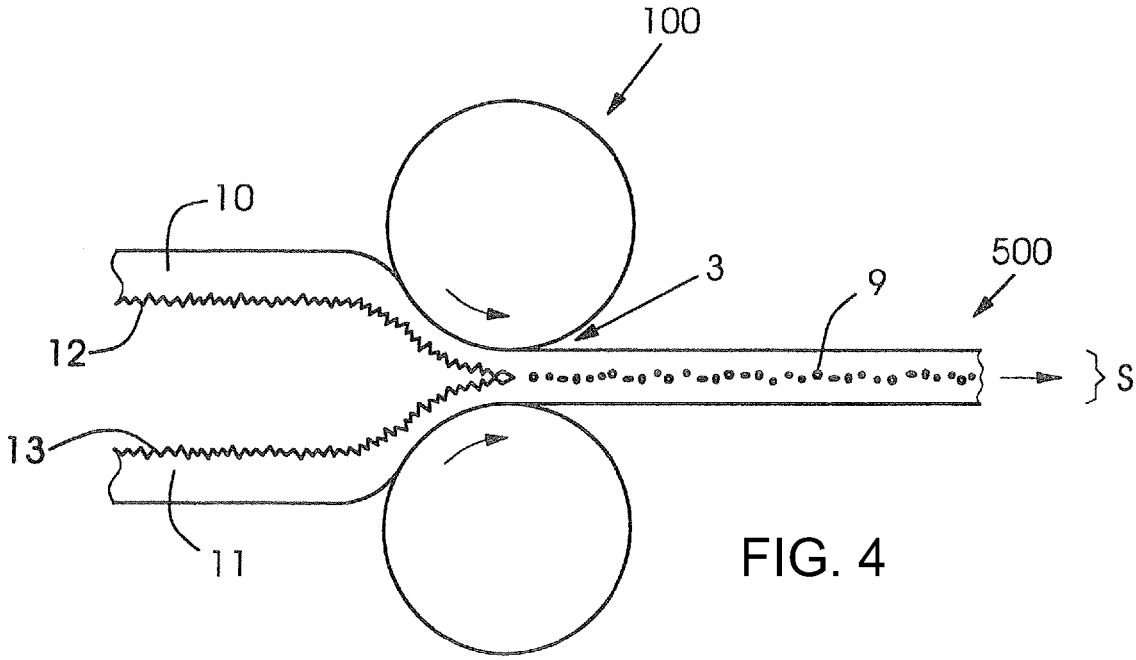
FIG. 4 illustrates a further embodiment of the manufacturing method according to the invention.

FIG. 4 shows a further embodiment of the manufacturing method according to the invention for manufacturing a layer sequence S. Another way of reducing the heat transfer is to roll cavities or pores 9 into a layer sequence 500 in a targeted manner by, for example, metal sheets 10, 11 with a rough surface 12, 13 being connected to one another. Surrounding air is stored in the rough surface 12, 13 during rolling, it not being possible for said surrounding air to escape any longer, and the latter leading to a deterioration in the intermetallic transition. The cavities 9 which are introduced are thus preferably filled with air. The cavities 9 can be introduced in one, a plurality of or all the repetition steps.

FIG. 5 shows a further embodiment of the manufacturing method according to the invention for manufacturing a layer sequence S. The use of only one type of metal A makes the manufacturing process of roll bonding easier, as no different elasticities lead here to curvatures or similar problems. In contrast, the use of different metals A and B can be advantageous, as the heat transfer can optionally be reduced further as a result.

FIG. 6 shows an embodiment of a layer system 600 and 610, comprising a respective layer sequence S, of the printing form according to the invention. On account of the above-mentioned possible problems when joining different metals A, B together during roll bonding, it is advantageous to manufacture a symmetrical initial stack 600, for example of the form A-B-B-A, in a first step. All the repeated stacks 610 which are obtained from this initial stack 600 are then likewise symmetrical (for example, A-B-B-A-A-B-B-A-A-B-B-A-A-B-B-A). As a result, identical metals with identical mechanical properties (also of the stack) can be joined together in all further roll bonding steps.

Figure 7:
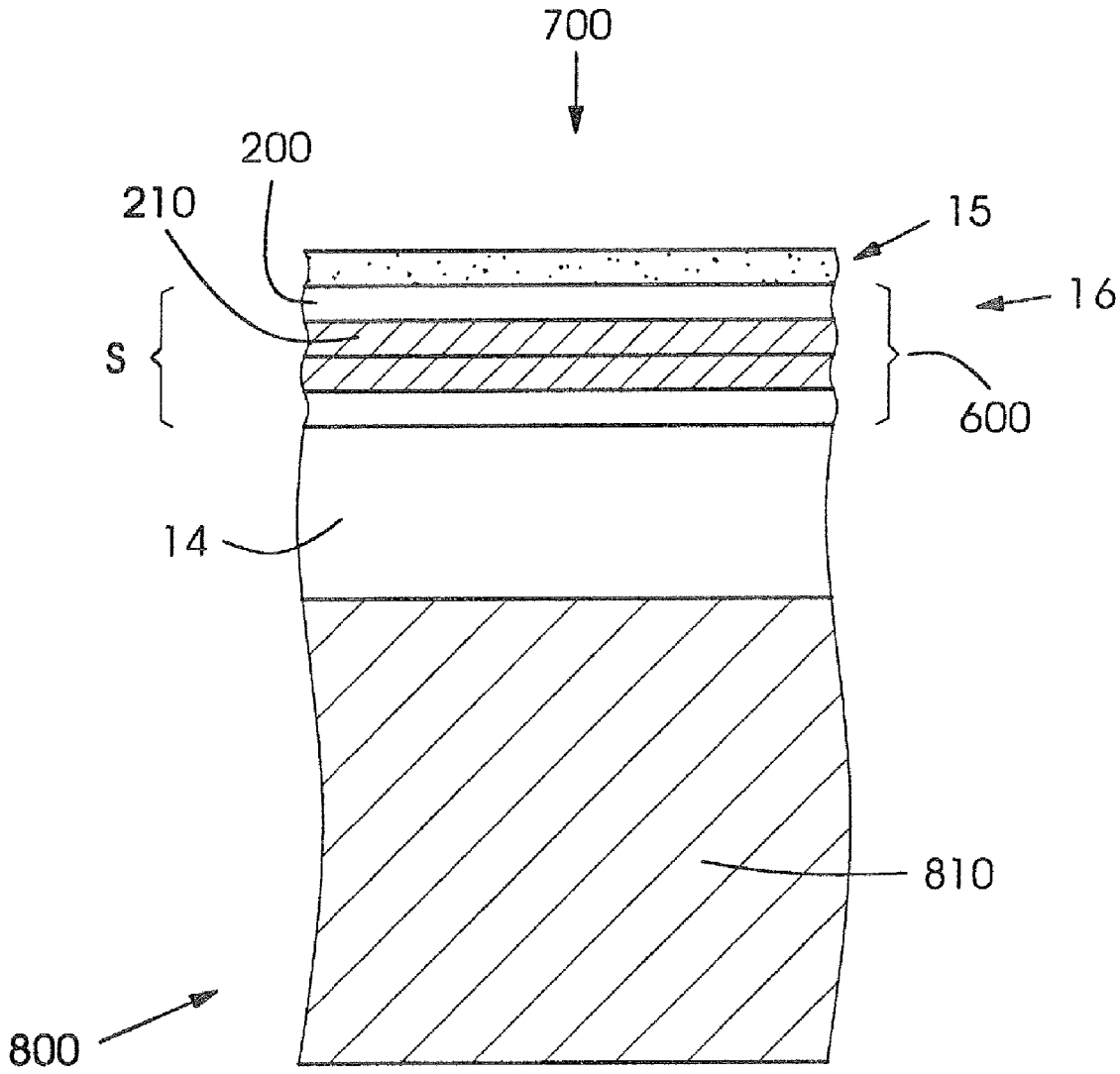
FIG. 7 is a partial sectional view of an exemplary embodiment of the printing form according to the invention.

FIG. 7 shows an embodiment of the printing form 700 according to the invention on a cylinder 810 (only a detail of which is shown) of a printing press 800 (only a detail of which is likewise shown). As the heat conductivity properties are required only in a region of some tens of micrometers near the surface, it is also possible to manufacture a layer sequence S of corresponding thickness and to connect it fixedly to a carrier 14, for example a steel or aluminum plate, in order to ensure the required mechanical properties, or also in order to reduce the costs (number of individual layers and thus of rolling steps). The connection to the carrier sheet 14 can likewise be carried out by means of roll bonding.

If the metal system which is used does not have the required chemical properties, it can be provided with a suitable terminating layer 15 in a final step, for example by vapor deposition, galvanization or another process. Moreover, the terminating layer 15 can be configured in such a way that the laser radiation is coupled into the surface as effectively as possible, that is to say in such a way that the reflection coefficient for the image setting wavelength is as low as possible.

For this purpose, the layer thicknesses and the respective refractive indices are to be adapted to one another. In the event of a given wavelength $\lambda$ of the image setting radiation, the layer thickness of the terminating layer 15 is preferably $n\lambda/4$, n being an odd integer which is preferably greater than 5. Here, the refractive index of the terminating layer 15 lies between the refractive index of air and the refractive index of the layer which lies below the terminating layer 15, and is preferably the root of the refractive index of the layer which lies below the terminating layer 15. Titanium dioxide ($TiO_2$) may be suitable, for example, as the material for the terminating layer 15.

Furthermore, a printing form 20 can comprise different individual stacks which are connected to one another and optionally to a carrier sheet. Thus, for example, it can be appropriate to have a thin stack on the surface, which stack comprises partially or completely titanium and/or zirconium, and underneath a thicker stack which comprises, for example, aluminum. Titanium and zirconium are good partners for covering with, for example, amphiphilic molecules which serve for the image setting of the printing form, whereas a stack made from aluminum is comparatively easier to manufacture and is cheaper in terms of the starting materials.

In comparison with a conventional printing form, a printing form 20 according to the invention which comprises a metallic layer stack or a layer sequence is more robust. This is because in the case where material is removed at the surface on account of overexposure, the same material appears again underneath and the properties of the printing plate are not changed substantially.

This application claims the priority, under 35 U.S.C. §119, of German patent application No. 10 2004 041 277.4, filed Aug. 25, 2004; the entire disclosure of the prior application is herewith incorporated by reference.

The invention claimed is:

1. An improved method of manufacturing a printing form having a thermally insulating layer, the method which comprises:

forming the thermally insulating layer by disposing a plurality of individual layers of metal sheets or metal strips to form an A-B-B-A layer sequence or a multiple of an A-B-B-A layer sequence of a multiple layer system, wherein A and B are given metals, the layer sequence being produced by roll bonding.

2. The method according to claim 1, wherein the metal A is titanium or zirconium and the metal B is aluminum.

3. The method according to claim 1, which comprises forming the layer sequence with a relatively reduced heat transfer between the layers of the layer sequence, by introducing foreign substances in a targeted manner between the layers of the layer sequence.

4. The method according to claim 3, wherein the introducing step comprises forming an oxide layer or a nitride layer.

5. The method according to claim 1, which comprises forming the layer sequence with a relatively reduced heat transfer between the layers of the layer sequence, by introducing cavities in a targeted manner between layers of the layer sequence.

6. The method according to claim 5, which comprises introducing the cavities by rolling metal sheets or strips with a rough surface.

7. The method according to claim 5, wherein the cavities are filled with air.

* * * * *